United States Patent [19]

Oelsch

[11] 4,032,728

[45] June 28, 1977

[54] PUSH BUTTON SWITCH

[75] Inventor: Jürgen Oelsch, Braunschweig, Germany

[73] Assignee: Olympia Werke AG, Wilhelmshaven, Germany

[22] Filed: Dec. 10, 1975

[21] Appl. No.: 639,607

[30] Foreign Application Priority Data

Dec. 20, 1974 Germany ..... 2460485

[52] U.S. Cl. ..... 200/5 A; 200/67 DB; 200/159 A; 200/159 B; 200/275

[51] Int. Cl.[2] ..... H01H 13/70; H01H 1/06; H01H 21/02

[58] Field of Search ..... 200/5 R, 5 A, 67 DA, 200/67 DB, 159 R, 159 A, 159 B, 275, 302, 329, 340, DIG. 1, 283, 292

[56] References Cited

UNITED STATES PATENTS

| | | | |
|---|---|---|---|
| 3,710,209 | 1/1973 | Webb et al. | 200/DIG. 1 |
| 3,786,205 | 1/1974 | Lien | 200/275 X |
| 3,796,843 | 3/1974 | Durkee et al. | 200/159 B X |
| 3,800,104 | 3/1974 | Lien et al. | 200/67 DA |
| 3,819,882 | 6/1974 | Anderson et al. | 200/159 A X |
| 3,826,882 | 7/1974 | Giolitti et al. | 200/67 DA X |
| 3,849,611 | 11/1974 | Walker, Jr. | 200/275 X |
| 3,858,020 | 12/1974 | Brannon | 200/159 A |
| 3,870,840 | 3/1975 | Rivetta et al. | 200/159 A X |
| 3,899,648 | 8/1975 | Murata | 200/159 B X |
| 3,911,233 | 10/1975 | Nakamura et al. | 200/159 B X |
| 3,916,135 | 10/1975 | Holden et al. | 200/159 B X |
| 3,917,917 | 11/1975 | Murata | 200/159 B X |
| 3,928,736 | 12/1975 | Drage | 200/275 X |
| 3,941,964 | 3/1976 | Yoder | 200/159 A |
| 3,967,084 | 6/1976 | Pounds | 200/159 B X |
| 3,969,600 | 7/1976 | Sims, Jr. | 200/5 A |

*Primary Examiner*—James R. Scott
*Attorney, Agent, or Firm*—Spencer & Kaye

[57] ABSTRACT

A push button switch mounted on a conductor-carrying insulator plate includes a push button to which an external operating force can be applied; an electrically conducting, resilient switch element carrying a movable contact and arranged on the plate within the operating range of the push button for effecting at least an indirect transmission of the operating force to the switch element; and at least one fixed contact carried by the plate. In the operating position the movable contact is in engagement with the fixed contact. The switch element is constituted by a planar sheet member having a central zone bounded by two parallel edges and carrying the movable contact, and strip-like legs integral with the central zone and extending from the edges towards the insulator plate at an inclination with respect to the central zone that is greater than 90°. The legs are supported at least indirectly on the insulator plate at conductor-free portions thereof. Alternative embodiments include the use of a common sheet member having stamped flexible contact areas integral therewith incorporating the design features of the singular switch element.

25 Claims, 8 Drawing Figures

FIG.1
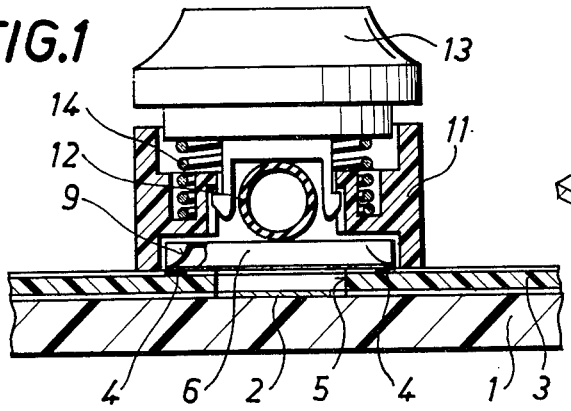
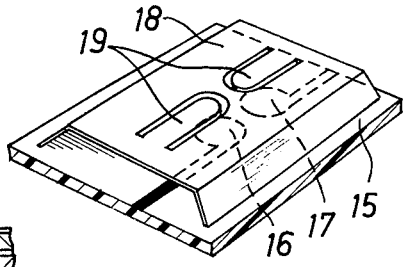
FIG.3
FIG.2
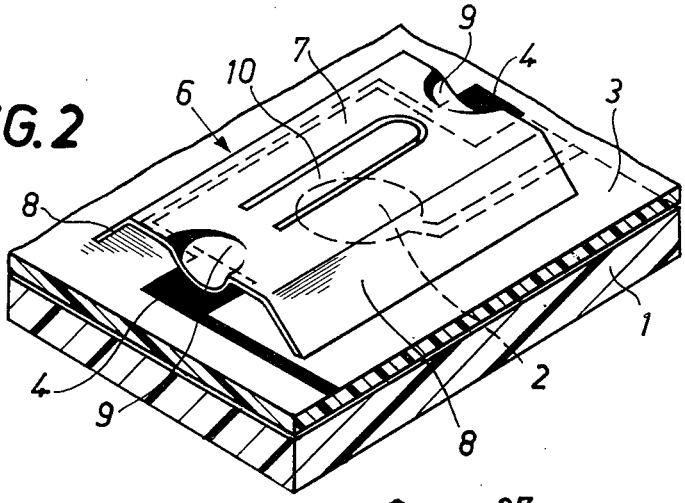
FIG.4
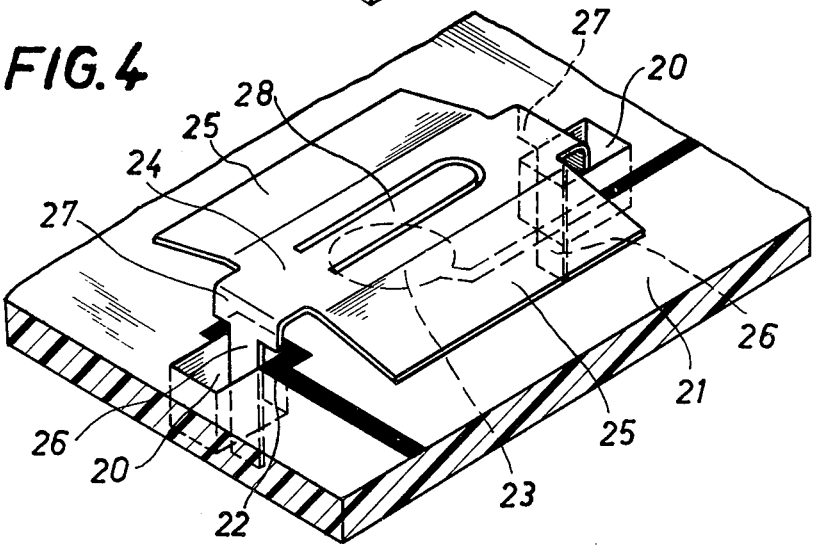

PUSH BUTTON SWITCH

BACKGROUND OF THE INVENTION

The present invention relates to a push button switch for electrical and electronic devices comprising a push button and an electrically conducting elastic switch element which is caused by the push button to move rapidly, in a snap action, from a normal position into an operating position in which it contacts at least one fixed contact attached to a conductor-carrying insulator plate, such as a printed circuit board. When the force exerted on the push button is removed, the elastic switching element returns to its normal position.

Known push button switches of the above-outlined type are utilized as individual electrical switches or as a group in a planar arrangement, for example for data input in keyboards of electronic computers or electrical typewriters. The elastic, snap action switch elements are designed either as cup-shaped contact springs as disclosed, for example, in U.S. Pat. No. 2,262,777, or as two contact frames each having a bent central strip and two contact pieces and are thickened at two opposite lateral edges as disclosed, for example, in German Laid-Open Application (Offenlegungsschrift) No. 2,411,426. Cup-shaped contact springs, however, form a surface which cannot be developed and thus require increased manufacturing costs. The same applies for a contact frame which is shortened at opposite lateral edges, and the central strip of which thus assumes a curved shape. Moreover, such contact frame can be used merely as a single switch and not as a one-piece switch element for a plurality of push button switches arranged along a line or a plane.

SUMMARY OF THE INVENTION

It is an object of the present invention to improve a push button switch of the above-outlined type so that its snap action switch element has planar and thus developable surfaces for simplifying its manufacture.

This object and others to become more apparent as the specification progresses, are accomplished by the invention according to which, briefly stated, the push button switch mounted on a conductor-carrying insulator plate includes a push button to which an external operating force can be applied; an electrically conducting, resilient switch element carrying a movable contact and arranged on the plate within the operating range of the push button for effecting at least an indirect transmission of the operating force to the switch element; and at least one fixed contact carried by the plate. The switch element has a normal position which it assumes and maintains when no operating force is exerted thereon by the push button. In the normal position the movable contact is out of engagement with the fixed contact. The switch element further has an operating position which it assumes in snap action motion and maintains when the operating force exerted thereon by the push button reaches a certain magnitude. In the operating position, the movable contact is in engagement with the fixed contact. The switch element is constituted by a planar sheet member having a central zone bounded by two parallel edges and carrying the movable contact, and strip-like legs integral with the central zone and extending from the edges towards the insulator plate at an inclination with respect to the central zone that is greater than 90°. The legs are supported at least indirectly on the insulator plate at conductor-free portions thereof.

The present invention makes it possible to manufacture a plurality of snap action switch elements in one piece without influencing one another when they are operated individually. The combination of a plurality of switch elements formed of a planar, laterally angularly bent sheet plate into a snap action contact strip or a one-piece snap action contact field, serves to provide a keyboard or a field of push buttons, respectively, at much less cost than previously possible while nevertheless entirely eliminating interference effects between the individually actuated movable contact elements.

BRIEF DESCRIPTION OF THE DRAWINGS

FIG. 1 is a sectional side elevational view of a first preferred embodiment of the invenion.

FIG. 2 is a perspective view of one part of the first embodiment.

FIG. 3 is a perspective view of one part of a second preferred embodiment of the invention.

FIG. 4 is a perspective view of one part of a third preferred embodiment of the invention.

DESCRIPTION OF THE PREFERRED EMBODIMENTS

Figure 6:
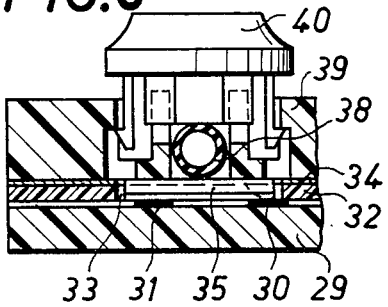
FIG. 6 is a cross-sectional view of the fourth embodiment, including a push button.

Turning now to FIGS. 1 and 2, a lower conductor-carrying insulator plate, such as alower printed circuit board 1 carries a fixed contact 2 which is one of the conductor lines. An upper conductor-carrying insulator plate, such as an upper printed circuit board 3, which is firmly connected to the lower printed circuit board 1, carries two electrically connected fixed contacts 4, likewise formed of conductor lines. The upper printed circuit board 3 is provided with an opening 5 (FIG. 1) in the area of the fixed contact 2. In case a plurality of push button switches are arranged on common boards 1 and 3, the latter are provided with a corresponding number of fixed contacts 2 and 4, while the upper board 3 is provided with the corresponding number of openings 5.

A switch element 6 disposed on the printed circuit board 3 is formed of a planar sheet of spring material (such as a resilient metal) which is bent angularly at its two longitudinal sides, so that the switch element has the shape of a flat roof as is clearly shown in FIG. 2. The switch element 6 thus comprises a flat center zone 7 and two longitudinal lateral strip-like legs 8 which are arranged at an obtuse angle with respect to the zone 7 and which are supported on insulating (i.e. conductor-free) portions of the board 3. Hump-like deformations 9 are pressed out of the center zone 7 at both ends of the switch element 6. An elongated U-shaped slot provided in the elevated, central zone 7 defines a contact tongue 10 which normally extends in the plane of the zone 7 and forms a portion thereof. The U-shaped slot may be made by etching or stamping.

As further seen in FIG. 1, there is provided a switch housing 11 which is permanently connected to the two printed circuit boards 1 and 3. The housing 11 positions the switch element 6 on the boards 1 and 3 so that the humps 9 are situated adjacent the fixed contacts 4 of the board 3 and the contact tongue 10 is positioned adjacent the fixed contact 2 of the board 1. The contact tongue 10 thus bridges the opening 5 in the board 3. An accumulator spring 12 of a rubber-elastic material and having a rod (preferably tube) shape, is arranged above the switch element 6 and is positioned by a push button 13 so that the longitudinal axis of the accumulator spring 12 extends at a right angle to the longitudinal dimension of the contact tongue 10. A reset spring 14 disposed between the switch housing 11 and the push button 13 assures that the push button 13 will return to its normal position when the force exerted thereon is removed.

The above-described push button switch according to FIGS. 1 and 2 operates as follows:

By applying an external force to the push button 13, the accumulator spring 12 as well as the reset spring 14 are compressed. During this occurrence the accumulator spring 12 is supported, by the switch element 6 or, more precisely, the strips 8, on the board 3. Moreover, the supporting hump-like deformations 9 which constitute movable contacts, arrive in electrically conducting engagement with the fixed contacts 4 of the board 3. A further increase in the force introduced and stored in the accumulator spring 12 effects a sudden snap action movement of the switch element 6 into a lower operating position in which the contact tongue 10 which constitutes a movable contact, extends downwardly and engages, through the opening 5 in the upper board 3, the fixed contact 2 of the lower board 1. In this operating position the switch element 6 acts in conjunction with the snapped-over contact tongue 10 as a contact bridge between fixed contacts 2 and 4. When the force acting on the push button 13 is removed, the elastic switch element 6 returns to its normal position in which the accumulator spring 12 and the push button 13 return to their respective positions of rest.

To simplify the switch structure, the reset spring 14 may be omitted. Its function is then performed by the accumulator spring 12. Instead of the two printed circuit boards 1 and 3 permanently attached to one another and each carrying conductors only on one face, it is feasible to use only one board provided with conductors either on one side or on both sides. Also, the tubular accumulator spring 12 which is made of a rubber-elastic material, may be replaced by a helical metal spring. It is to be understood that instead of printed conductors, the boards 1 or 3 may carry sheet metal conductor strips attached thereto.

Turning now to the embodiment illustrated in FIG. 3, a printed circuit board 15 has fixed contacts 16 and 17 on its surface and there is further provided a switch element 18 which, similarly to component 6 of the earlier-described embodiment, has the shape of a flat roof. In the center zone of the switch element 18 two longitudinally extending, aligned contact tongues 19 are arranged, with their free end facing one another. When the switch element 18 is actuated as described earlier, the contact tongues 19 engage the respective fixed contacts 16 and 17 to thus establish electric contact therewith.

According to the embodiment of FIG. 4, a rectangular switch element 24 is arranged on a printed circuit board 21 having fixed contacts 22 and 23 and being provided with openings 20. The switch element 24 is supported on insulating (i.e. conductor-free) zones of the board 21 by means of downwardly bent lateral strip-like legs 25 which form an integral part of the switch element 24. Support tabs 26 extend perpendicularly downwardly from the longitudinal ends of the elevated, flat zone of the switch element 24. Each tab 26 extends into an opening 20 of the board 21 for positioning the switch element 24. Each tab 26 is provided with a shoulder 27 which can be brought into an electrically conducting contact with the fixed contact 22 (or, if required, with fixed contacts 22 provided adjacent both shoulders 27) when the push button (not shown) is actuated. Thus, the shoulders 27 have the function of the hump-like deformations 9 as described earlier. A contact tongue 28, provided in the center zone between the tabs 26, will snap into a lower operating position — for reasons described in connection with the first embodiment (FIGS. 1 and 2) — in which it engages the fixed contact 23. In this operating position the switch element 24 electrically connects the fixed contact 22 with the fixed contact 23.

Figure 5:
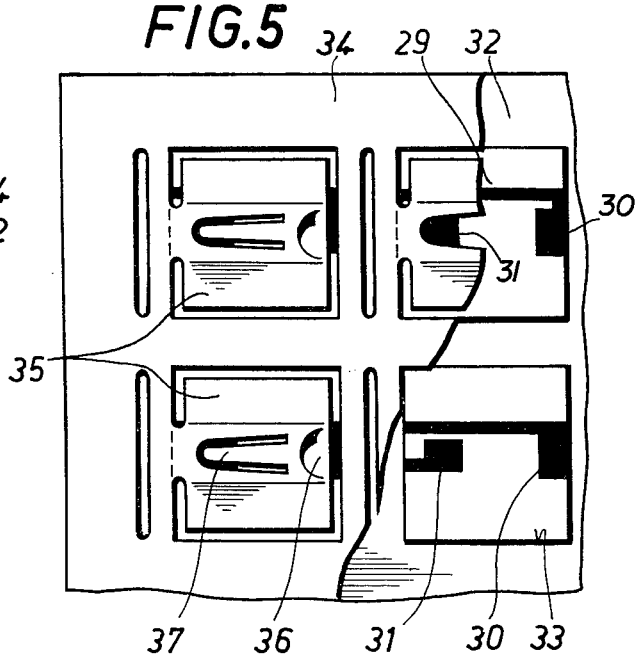
FIG. 5 is a fragmentary top plan view of one part of a fourth preferred embodiment of the invention illustrating the use of plural flexible contacts having a common sheet member.
Figure 7:
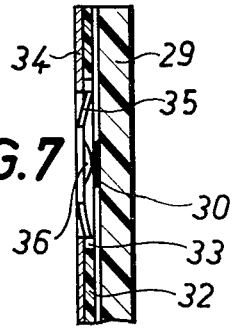
FIG. 7 is a longitudinal sectional view of the fourth embodiment.

FIGS. 5 through 7 show an embodiment in which a plurality of switch elements, each associated with a separate push button, are combined into a one-piece structure. On a printed circuit board 29 having fixed contacts 30 and 31, an insulating layer 32 is disposed which is provided with openings 33 in registry with the fixed contacts 30 and 31. A common plate 34 of spring material is arranged on the insulating layer 32 and is provided, for example, by a stamping operation, with a plurality of rectangular switch elements 35 which may be caused to resiliently move with respect to the plate 34. The switch elements 35 extend through openings 33 in the insulating layer 32. The individual switch elements 35 have the shape of a roof (FIG. 7) which has a flat center zone, and are bendably connected with the plate 34 at one edge of the center zone. At the opposite edge the switch elements 35 are provided with humps 36 oriented towards the board 29. A contact tongue 37 forms part of the center zone of each switch element 35. The supporting humps 36 are disposed above the fixed contacts 30 and the contact tongues 37 are disposed above the fixed contacts 31. Each switch element 35 further has integral, lateral strip-like legs which extend at an angle to the flat center zone and which are supported on conductor-free portions of the board 29.

An accumulator spring 38, constituted, for example, by a rubber-elastic tube, is arranged on the plate 34 in such a manner that it extends over a plurality of switch elements 35 (forming one row) perpendicularly to the length dimension of the contact tongues 37 associated therewith. The accumulator spring 38 stores the force exerted on the respective switch element 35 until the latter moves by snap action as described in detail earlier. The accumulator spring 38 is positioned by a switch housing 39 (which is permanently attached to the overall assembly) in such a manner that the accumulator spring 38 is disposed approximately over the center of the switch elements 35 belonging to the same row. Centrally above each switch element 35 there are positioned push buttons 40 which are provided with detent tongues and are guided in the switch housing 39 by a transverse slot guide.

Upon actuation of one of the push buttons 40 by the application of an external (e.g. manual) force, the accumulator spring 38 is compressed in the center zone of the respective switch elements 35. Under the influence of the introduced forces this switch element 35 bends downward and engages the board 29 with the strip-like legs. The latter, as the force transmitted by the spring 38 increases, spreads out until the hump 36 comes to rest on the fixed contact 30. A further increase in pressure on the accumulator spring 38 then causes a sudden snap action of the switch element 35, as a result of which it assumes a lower operating position in which the contact tongue 37 engages the fixed contact 31 and supports itself thereon with a certain force (contact force). In this operating position, the switch element 35, in conjunction with the integrated contact tongue 37, acts as a contact bridge, electrically connecting with one another the fixed contacts 30 and 31.

Figure 8:
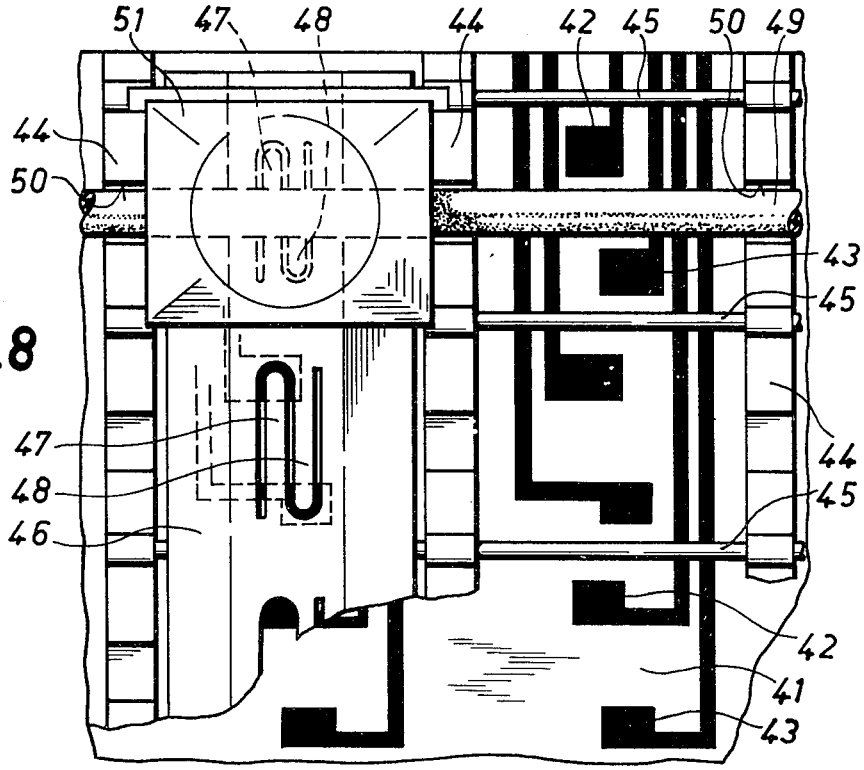
FIG. 8 is a top plan view of a fifth preferred embodiment of the invention having a different plural flexible contact configuration with a common sheet member.

FIG. 8 illustrates an embodiment comprising a plurality of switch elements (each associated with a separate push button) which are combined into a one-piece strip. On a printed circuit board 41 having fixed contacts 42 and 43, a housing is provided which has longitudinal rungs 44 and transverse rungs 45. Between the longitudinal rungs 44, roof-shaped bistable switch element strips 46 (each formed of a plurality of switch elements) are provided which are supported with their longitudinal strip-like legs on the transverse rungs 45. Spaced contact tongue pairs each formed of contact tongues 47 and 48 provided, e.g. by stamping, in the flat center zone of each switch element strip 46, extend in the longitudinal direction of the strip 46. The contact tongues 47, 48 in one contact tongue pair are arranged side-by-side in opposite orientation. The strips 46 are positioned on the board 41 by the longitudinal struts 44 so that each pair of contacting tongues 47, 48 is arranged centrally between two transverse rungs 45 and above the associated fixed contacts 42 and 43. It is to be understood that strips 46 of any desired length and any desired number can be arranged in parallel and combined with a field of push buttons. Accumulator springs 49 are disposed above and at a right angle to the strips 46 and the contact tongue pairs 47, 48, centrally between any two transverse rungs 45. The accumulator springs 49, which may be formed as rubber-elastic tubes, are inserted into recesses 50 in the longitudinal rungs 44 and are actuated by push buttons 51.

By applying an external (manual) force to a selected push button 51, the accumulator spring portion situated under the actuated push button 51 is compressed, thus storing the force exerted thereon, since reaction forces are simultaneously applied thereto by the underlying portion of the switch element strip 46. As the increasing force applied to the accumulator spring 49 reaches a certain value, the strip portion supported by the two adjoining transverse rungs 45 rapidly moves, in a snap action, into a lower operating position in which the snapped-over contact tongue pair 47, 48 engages the fixed contacts 42, 43. Thus, in this operating position the contact tongue pair 47, 48 acts as a contact bridge electrically connecting the fixed contacts 42 and 43 with one another.

The push button switch structured according to the invention and described above in the five preferred embodiments, excels by its small structural height, extremely small chatter periods in both switching directions (opening and closing) and a very reliable signal transmission even under the most adverse conditions. Further, they provide for a tactile feedback indicating to the operator the occurrence of the switching operation.

It will be understood that the above description of the present invention is susceptible to various modifications, changes and adaptations, and the same are intended to be comprehended within the meaning and range of equivalents of the appended claims.

What is claimed is:

1. A push button switch mounted on a conductor-carrying insulator plate and having a push button to which an external operating force can be applied; an electrically conducting, resilient switch element including a movable contact means and arranged on the plate within the operating range of the push button for effecting a transmission of the operating force from the push button to the switch element; at least one fixed contact carried by the plate; the switch element having a normal position which it assumes and maintains when no operating force is exerted thereon by the push button; in the normal position the movable contact means being out of engagement with the fixed contact; the switch element having an operating position which it assumes in snap action motion and maintains when the operating force exerted thereon by the push button reaches a certain magnitude; in the operating position the movable contact means being in engagement with the fixed contact; the improvement wherein said switch element being constituted by a planar sheet member having a. a central zone including two parallel bounding edges and carrying said movable contact means; and b. strip-like legs integral with said central zone and extending from said edges towards said plate at an inclination with respect to said central zone that is greater than 90°; said legs being positioned on said plate at conductor-free portions thereof.

2. A push button switch as defined in claim 1, said movable contact means being constituted by at least one contact tongue attached to said central zone and forming part thereof.

3. A push button switch as defined in claim 1, said movable contact means being constituted by two elongated contact tongues attached to said central zone and forming a part thereof; each contact tongue having a free end; said contact tongues being in lengthwise alignment and the free ends of the contact tongues being oriented towards one another.

4. A push button switch as defined in claim 1, said movable contact means being constituted by two side-by-side arranged, elongated contact tongues attached to said central zone and forming part thereof; each contact tongue having a free end; the free ends of the contact tongues being oriented in opposite directions.

5. A push button switch as defined in claim 1, further comprising an additional movable contact means formed on at least one end of said central zone; said additional movable contact means being movable into engagement with a fixed contact on said conductor-carrying plate by an operating force that is below said certain magnitude.

6. A push button switch as defined in claim 5, wherein there are provided first and second superposed conductor-carrying plates, a first fixed contact attached to said first plate and a second fixed contact attached to said second plate; said legs of said switch element being supported on said first plate; said additional movable contact means being arranged to cooperate with said first fixed contact; said movable contact means being constituted by a contact tongue attached to said central zone and forming a part thereof; said first plate including means defining an opening aligned with said contact tongue on said switch element and said second fixed contact on said second plate; said contact tongue being arranged to cooperate with said second fixed contact through said opening.

7. A push button switch as defined in claim 5, wherein said additional movable contact means comprises two additional movable contact members at opposite ends of said central zone, said additional contact members being formed as bulging deformations of portions of said central zone; said deformation projecting towards said conductor-carrying plate; said movable contact means being constituted by a contact tongue attached to said central zone and forming a part thereof; said contact tongue being positioned between said two deformations.

8. A push button switch as defined in claim 7, wherein said contact tongue is of elongated shape; said contact tongue being in lengthwise alignment with said two bulging deformations.

9. A push button switch as defined in claim 5, wherein said additional movable contact means comprises two additional movable contact members at opposite ends of said central zone, said additional contact members being formed as tabs extending from said central zone through openings in said conductor-carrying plate; at least one tab having a shoulder portion cooperating with a fixed contact attached to said plate.

10. A push button switch as defined in claim 9, said movable contact means being constituted by a contact tongue attached to said central zone and forming part thereof; said contact tongue being positioned between said tabs.

11. A push button switch as defined in claim 1, wherein there are provided a plurality of switch elements disposed in a spaced, coplanar arrangement; said switch elements being formed from and attached to a single sheet plate member to constitute therewith a one-piece structure; each of the plurality of switch elements forming part of an independently operable push button switch.

12. A push button switch as defined in claim 11, the central zone of each switch element having two additional parallel bounding edges; each switch element being attached to said single sheet plate member along one of the additional bounding edges; further comprising an additional movable contact means formed at the other of the additional bounding edges of the central zone of each switch element; each additional movable contact means being movable into engagement with a fixed contact on said conductor-carrying plate by an operating force that is below said certain magnitude.

13. A push button switch as defined in claim 11, said movable contact means of the respective switch elements being constituted by at least one contact tongue cut out from and being attached to the central zone of each switch element.

14. A push button switch as defined in claim 11, further comprising an insulating sheet sandwiched between said conductor-carrying plate and said sheet plate member carrying said switch elements; and means defining a plurality of openings in said insulating sheet; a separate one of said switch elements projecting towards said conductor-carrying plate through each said opening.

15. A push button switch as defined in claim 11, wherein a plurality of said switch elements being in side-by-side alignment and forming a row; further comprising a rod-shaped accumulator spring disposed between said sheet plate member and the push buttons for transmitting the operating force from the push buttons to the respective switch elements; said accumulator spring extending successively over all the switch elements of the same row.

16. A push button switch as defined in claim 1, further comprising an accumulator spring disposed between said push button and said switch element for transmitting the operating force from said push button to said switch element.

17. A push button switch as defined in claim 16, wherein said accumulator spring is constituted by a rubber-elastic rod-shaped member positioned over said movable contact means transversely to the length dimension of said legs.

18. A push button switch as defined in claim 17, wherein said rod-shaped member is a tube.

19. A push button switch as defined in claim 17, said movable contact means being constituted by at least one elongated contact tongue attached to said central zone and forming a part thereof, said rod-shaped member extending over the contact tongue transversely to the length dimension thereof.

20. A push button switch as defined in claim 1, wherein there are provided a plurality of switch elements combined in an integral switch element strip; said movable contact means being formed of a plurality of movable contact members attached to said central zone; said movable contact members being spaced from one another in the length dimension of the switch element; each movable contact member being associated with a separate independently operable push button.

21. A push button switch as defined in claim 20, wherein each movable contact member is constituted by two side-by-side arranged, elongated contact tongues attached to said central zone and forming part thereof; each contact tongue having a free end; the free ends of the contact tongues being oriented in opposite directions.

22. A push button switch as defined in claim 20, wherein there are provided a plurality of side-by-side arranged, parallel extending switch element strips.

23. A push button switch as defined in claim 20, further including at least two parallel-spaced longitudinal rungs attached to said plate; said switch element strip extending between said longitudinal rungs; and a plurality of parallel-spaced transverse rungs attached to said plate and extending substantially normal to said longitudinal rungs; between any two of said transverse rungs there is arranged one of said movable contact members; said legs being supported directly by said transverse rungs.

24. A push button switch as defined in claim 23, further comprising a rubber-elastic rod-shaped accumulator spring arranged centrally between and parallel to every two transverse rungs; the accumulator springs extending substantially perpendicularly to the switch element strip for transmitting the operating force from an actuated push button to said switch element.

25. A push button switch as defined in claim 24, wherein there are provided a plurality of side-by-side arranged switch element strips; each rod-shaped accumulator spring extending successively over a plurality of switch elements belonging to different ones of said switch element strips.

* * * * *